US005314193A

United States Patent [19]

Ferrer

[11] Patent Number: 5,314,193

[45] Date of Patent: May 24, 1994

[54] METHOD OF PLAYING A WAGERING CASINO TYPE

[76] Inventor: Emilio Ferrer, 4820 E. 60th Pl., Maywood, Calif. 90270

[21] Appl. No.: 20,633

[22] Filed: Feb. 22, 1993

[51] Int. Cl.[5] ..... A63F 1/00

[52] U.S. Cl. ..... 273/292

[58] Field of Search ..... 273/292, 274, 309

[56] References Cited

U.S. PATENT DOCUMENTS 5,072,946 12/1991 Miller ..... 273/292

5,141,234 8/1992 Boylan ..... 273/306

OTHER PUBLICATIONS

Scarne's Encyclopedia of Games by John Scarne, Harper & Row Publishers, 1973, pp. 276–294.

*Primary Examiner*—Benjamin H. Layno

*Attorney, Agent, or Firm*—Natan Epstein

[57] ABSTRACT

In a game suitable for casino play a two card hand is dealt to each player, who may then draw at least one additional card after placing a wager. The winning card hand is determined according to the following rules: the point value of each natural number card is its face value and all figure cards and jokers have a value of ½ point; any hand adding up to an integer plus ½ point wins over any hand adding up to an integer only value; as between hands adding up to an integer plus ½ point, the hand with the higher integer value wins; and all hands adding up to an integer value tie with each other.

27 Claims, 1 Drawing Sheet

NEAT 1/2
a
b
= 10 1/2
BEATS
c
= 9 1/2
BEATS
d
= 8 1/2
BEATS
e
= 7 1/2
BEATS DOWN TO
f
= 1 1/2
BEATS DOWN ALL
g
= WHOLE #
TIES
h
= WHOLE #

METHOD OF PLAYING A WAGERING CASINO TYPE

BACKGROUND OF THE INVENTION

1. Field of the Invention

The present invention pertains to the field of games of chance and more particularly relates to a card game suitable for play in casinos for money wagers.

2. State of the Prior Art

Various card games are played in casinos for money wagers. Among the more popular games of this type are poker in its many variations, and blackjack, also known as "21". These two card games are quite different as to the participation of a casino. In poker several players play each against all of the other players, or one against all. The casino participates in the game by providing a card dealer and taking a share of each "pot" of wagers placed by the players on each hand of the game. The casino does not itself play against the other players.

In blackjack, however, the players do not play against each other but rather against a card dealer who plays for the casino. The casino therefore wins, loses, or ties against each player individually in each hand of the game. Each player wagers against the dealer, and the wager is collected by the dealer if the dealer's hand wins, or the dealer pays to the player an amount equal to the player's wager if the dealer's hand loses to that of the particular player. Over the long run, the casino tends to win by playing according to certain rules, against players who do not necessarily play by the same rules and thereby reduce their odds against the dealer.

Casino gambling is closely regulated in most jurisdictions. A few states allow a wide range of casino games to be played, most states allow no casino gambling, while a few permit a limited range of games to be played for money wagers in licensed casinos. The State of California is an example of the latter case. Certain cities in the State of California have legalized the playing of card games such as poker in which the casino only participates by taking a percentage of the wagers placed in return for providing the gaming facilities. The players do not, however, play against the casino. The most widely played card game in these jurisdictions is poker, in its many variations.

A need exists for new games suitable for play in gaming establishments, licensed under the California laws, in order to enhance the variety of games available to players in that and other similar jurisdictions. Such new games should not only comply with legal requirements, for example, that the casino patrons play against each other only and not against the casino, but should also be of a nature which provides an attractive financial return to the casino. Since the casino can only collect a percentage of the wagers, the revenue to the casino is improved with quick turnover of the wagers. In other words, the faster money changes hands at the card table, the more revenue is generated for the casino. This calls for a game where each hand is played quickly, without lengthy deliberation by the players.

SUMMARY OF THE INVENTION

The aforementioned need is addressed by the card game of this invention which is played with a deck of fifty six playing cards, made up of a standard poker deck of fifty two cards plus four Joker cards. A card dealer, typically an employee provided by a casino, deals an initial card hand consisting of two cards to each of two or more players. Each player is then offered the option to draw either one or two additional cards which are added to the player's initial card hand. The card hands of all players are then exposed to determine the winning card hand according to the following rules:

the point value of each natural number card (Ace through 10) is its face value, and all figure cards and jokers have a value of one half point;

any hand adding up to an integer plus one half point wins over any hand adding up to an integer only value. As between hands adding up to an integer plus one-half point, the hand with the higher integer value wins; and all hands adding up to an integer only value tie with each other.

In a gambling casino setting, the game also includes the placing of a wager by each player before the player is dealt the initial card hand. The wagers are collected after the winning hand has been determined, and the collected wagers are paid to the player holding the winning hand, or in case of a tie, the collected wagers are distributed in equal shares among the players holding the tied hands.

Each player may optionally split an initial card hand consisting of two cards of equal face value. This split may be done in one of two ways. In a first alternative, the player places the two cards face down as split card hands on the playing surface of the card table, and the split card hands are subsequently played as separate hands by optionally drawing from the dealer one or two additional cards on one or both of the split card hands, for a maximum of three cards in each of the separate card hands. The dealer deals the first of the two cards optionally drawn on the split card hands face up on the playing surface, and the second of the two additional cards is dealt face down on the playing surface. In a second alternative form of splitting the initial card hand, the two cards are placed face up on the playing surface as split card hands, and the player optionally draws from the dealer a single additional card on one or both of the split card hands, for a total of two cards for each split card hand.

The card game as described in the preceding paragraphs is played by each player against all other players. In an alternate form of this card game, one of the players is designated as the banker. This alternate form of the game differs in that, after exposing the card hands of all players, the card hand of every other player is compared to the card hand of the banker, to determine the winning hand as between the banker and each player. The banker takes the wager placed by each player whose card hand loses to the card hand held by the banker, and the banker pays to each player whose card hand wins against the card hand of the banker an amount equal to the wager place by that player.

The banker must draw from the dealer an additional card for any card hand held by the banker adding up to or less than $4\frac{1}{2}$ points. The banker must continue to draw cards from the dealer until the banker's hand adds up to more than $4\frac{1}{2}$ points. Further, the banker may not split into separate card hands an initial card hand consisting of two $\frac{1}{2}$ point value cards. However, the banker may draw up to three additional cards, for a total of a five card hand, in the event the banker is dealt an initial card hand consisting of two cards of $\frac{1}{2}$ point value.

DETAILED DESCRIPTION OF THE PREFERRED EMBODIMENTS

Figure 1:
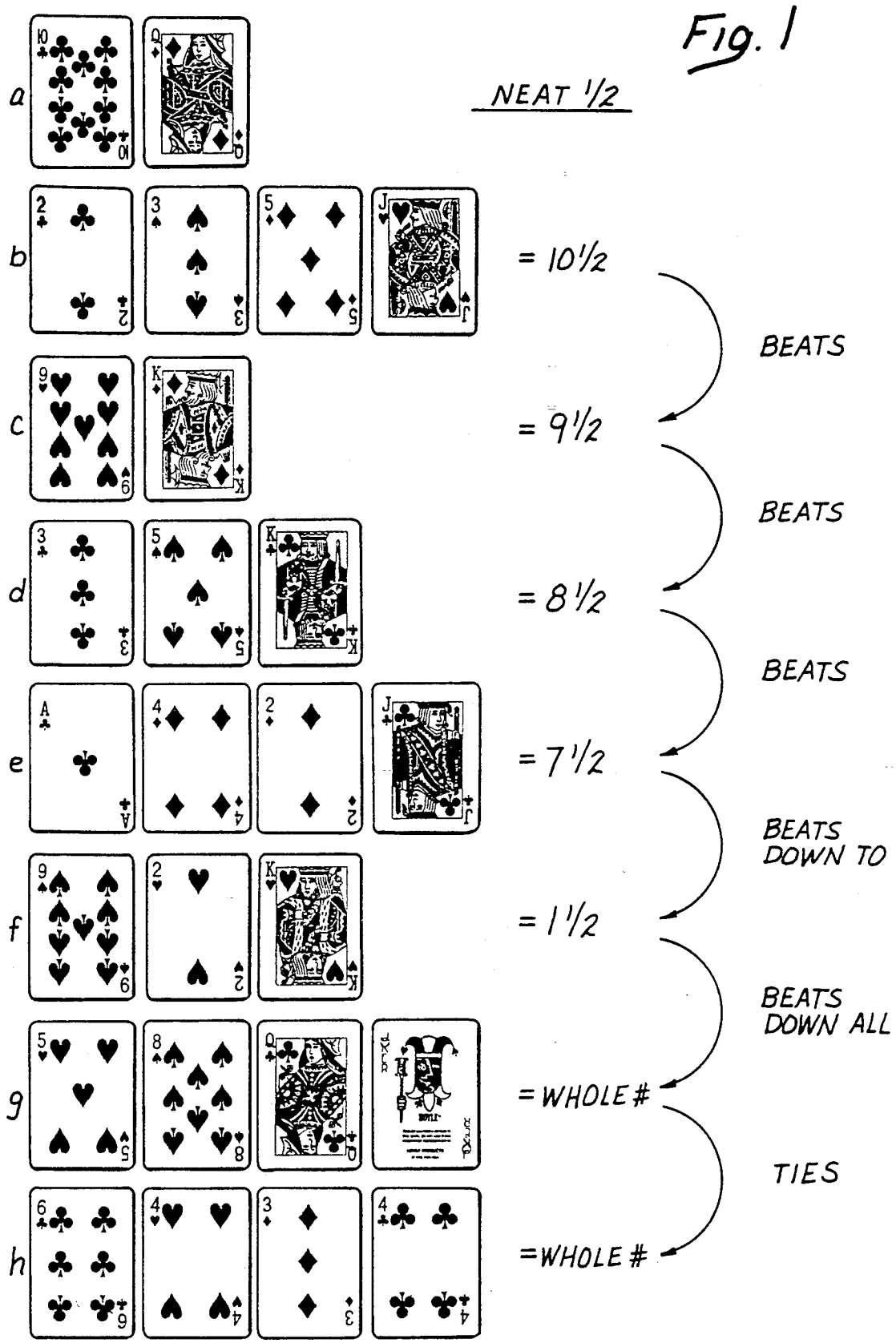
FIG. 1 illustrates the ranking of card hands designated by letters a through h, according to the game of this invention.

With reference to the drawing, the card game of this invention is played with a conventional poker deck of cards which consists of cards ranging in face value from 1 (the Ace card) through 10, and three figure cards including the Jack, the Queen and the King cards. Each of these thirteen cards is represented in four suits of cards, the four suits being Club, Spade, Diamonds and Hearts. The four suits of thirteen cards each make up a conventional poker deck of fifty two cards. To this poker deck are added four Joker cards, for a total of fifty six playing cards.

The natural number cards, i.e. the Ace card and cards numbered from 2 to 10, are assigned a whole number point value equal to their face number. Thus, a 10 card has a point value of 10 points, an Ace card has a point value of 1, and so forth for the remaining intermediate cards between 1 and 10. The figure cards, Jack, Queen and King are all assigned a point value of ½ point. The Joker cards are considered figure cards and are also assigned a point value of ½ point. These point value assignments hold true regardless of the suit of the card.

Play of this card game in a casino setting calls for a card dealer, which is normally an employee of the casino, and at least two players, at a card table or other playing surface.

Each player places a wager on the playing surface according to his or her judgment and any casino rules which may affect the wager amounts.

The card dealer then deals face down an initial card hand consisting of two cards to each player at the table. Each player looks over his card hand and makes a mental judgment of the odds of that hand winning over the card hands of the other players in the game. Since the initial card hand is dealt face down, the players cannot view the card hands of others at the table The dealer then offers each player in turn the option to draw one or two additional cards to be added to the initial card hand of the player. Once all players have exercised or passed on this option, the card dealer exposes the card hands of all players to determine the winning card hand according to the following rules:

1) Any hand adding up to an integer plus ½ point wins over any hand adding up to an integer only value.

2) As between hands adding up to an integer plus ½ point, the hand with the higher integer value wins.

3) All hands adding up to an integer only value tie with each other.

4) A two card hand adding up to 10½ points, called a "Neat ½", wins over any other hand of equal 10½ point value but made up of three or more cards.

5) For card hands adding up to any other integer (1 through 9) plus ½ point, hands of equal point value tie with each other whether the hands are made up of two or more cards.

6) Any card hand adding up to an integer greater than 10 acquires the value of the second digit only. Thus, a card hand actually adding up to 11½ points has a hand point value of 1 ½ points, and loses to another card hand actually adding up to only 7½ points. A card hand actually adding up to 17 points counts as 7 points for the card hand point value. Because of this a player cannot "bust" by drawing additional cards, i.e., no hand can accumulate a point value greater than 10½. The adding up of each card hand is done by taking the arithmetic sum of the individual point values of all cards constituting the card hand.

The object of the game is to draw a card hand of the highest possible numerical value, 10 and ½ points being highest possible. A card hand cannot win unless it adds up to an integer plus ½ point. This also means that a winning card hand must have an odd number of ½ point value cards, e.g. ($\frac{1}{2}+\frac{1}{2}+9+\frac{1}{2}=10\frac{1}{2}$) or ($3+\frac{1}{2}+5=8\frac{1}{2}$), since an even number of such cards (e.g. $\frac{1}{2}+2+3+\frac{1}{2}=6$) will result in an integer only total point value for that hand, and all integer only point value card hands tie with each other. For example ($2+\frac{1}{2}+4+\frac{1}{2}=7$) ties with ($\frac{1}{2}+3+\frac{1}{2}+10=14$, which counts as 4 points for the hand) and ($1+10+8+3=22$, which counts as 2 points for the hand).

Once the winning card hand is determined, the wagers placed prior to the dealing of the initial card hand by all players at the table are collected and paid to the player holding the winning hand. A tie can occur between some or all of the players. In a game where e.g. five players participate, two players may tie in a given hand if they both hold hands adding up to an integer of equal value plus ½,(e.g. 9½ points each) and which is also higher than the point value of any other hands held by the remaining players. In such a case, the two tied players share the collected wagers placed during that particular hand of the game. In a hand where no player at the table holds a hand adding up to an integer plus ½ point, i.e. all players hold hands adding up to an integer only value (1, 2, 3, up to 10), then all players tie with all others, and the collected wagers, i.e. the "pot", is divided equally among all players. In such case, a player who places a relatively small bet effectively wins since he or she will participate equally with other players who placed larger bets. Those other players in turn receive less than their wager and effectively lose part of their wager for that particular card hand.

Any player has the option to split an initial card hand consisting of two cards of equal face value, regardless of suit, in one of two ways. A first manner of splitting the card hand is by placing the two cards face down as split card hands on the playing surface, the split card hand being subsequently played by that player as separate card hands by optionally drawing from the card dealer one or two additional cards on one or both of the two split card hands, for a maximum of three cards in each of the split card hands. Where the player exercises the option to draw additional cards on one or both of the two split card hands, the first card dealt on each card hand is dealt face up on the playing surface, and the second of the two additional cards on each split card hand is dealt face down on the playing surface.

A second manner of splitting an initial card hand is by placing the two cards of the initial card hand face up on the playing surface as split card hands, in which case the player has the option of drawing from the card dealer a single additional card, which is dealt face down on the playing surface, on one or both of the split card hands for a total of two cards for each of the split card hands. The card which is laid face down cannot be seen by the other players until the end of the hand, i.e. when all card hands held by the players at the table are exposed.

The card game of this invention can also be played in a second form in which one of the players is designated as the banker, and all other players at the table play against the banker rather than against all other players. According to this second form of the card game, the card hand of every other player is compared to the card hand of the banker after the card hands have been exposed, to determine the winning hand as between the banker and each of the other players. The wager of each player whose card hand loses to the card hand held by the banker is paid to the banker. The banker pays to each player whose card hand wins against the card hand of the banker an amount equal to the wager placed by that player. The players only win or lose as against the banker and not as against each other. Where permitted by law, the banker and the card dealer may be one and the same, in which case the dealer plays for the casino.

In this second form of the card game, the banker is subject to additional rules which do not apply to the remaining players at the table. Specifically, the banker must draw from the card dealer an additional card for any card hand held by the banker adding up to or less than 4½ points. In other words, the banker must keep drawing cards until his card hand exceeds 4½ points. In addition, the banker may not split into separate card hands an initial hand consisting of two ½ point value cards. However, in the event the banker is dealt an initial card hand consisting of two cards of ½ point value, the banker may draw up to three additional cards on that hand for a total of a five card hand.

Turning now to the drawings, FIG. 1 illustrates card hands 1*a* through 1*h*, which are ranked according to point value such that any hand in the ranking wins over those below it, but loses to those above it, with the exception of hands 1*g* and 1*h* which are examples of whole number or integer value only hands which tie with each other regardless of point value of the card hand.

Hand 1*a* is a "Neat ½" which in the example shown consists of a 10 of Clubs and a Queen of Diamonds. A Neat ½ hand can be made up of any figure card combined with any "10" card. A "Neat ½" card hand wins over any other card hand which also adds up to 10½ points but consists of more than two cards, such as shown in FIG. 1*b*, where three cards (2 of Clubs, 3 of Spades, 5 of Diamonds and Jack of Hearts) total 10½ points for the card hand. This hand, however, is not a "Neat ½" and loses to the card hand of FIG. 1*a*.

FIGS. 1*c*, 1*d*, and 1*e* illustrate card hands having a point value of 9½, 8½, and 7½ respectively. The hand of FIG. 1*c* is made up of only two cards, a 9 of Hearts and a King of Diamonds, for a total card hand point value of 9½ points. In FIG. 1*d*, the card hand includes a 3 of Clubs, a 5 of Hearts and King of Clubs, for a total card hand point value of 8½. The card hand of FIG. 1*e* includes an Ace of Clubs having a point value of 1, a 4 of Diamonds, a 2 of Diamonds and a Jack of Clubs, for a total card hand point value of 7½. As between card hands adding up to an integer value plus ½ point, the card hand having the higher integer value beats another hand of lower integer value, as ranked in the drawing. The one exception to this ranking is the "Neat ½" hand, which wins against another hand of equal point value but made up of more than two cards, i.e. made up of more than the initial card hand dealt by the card dealer to a player.

FIG. 1*f*, shows the lowest possible winning hand, adding up to 1½ points for the hand. In the illustrated example of FIG. 1*f*, the card hand is made up of a 9 of Clubs plus a 2 of Hearts, adding up to 11 integer points. As earlier explained, the first digit of any integer value greater than 10 is disregarded, so that the 11 integer points count as a single integer point, i.e. 1 point value. To this is added the ½ point of the King of Hearts, for a total of 1½ points for this card hand.

Finally, the card hands of FIGS. 1*g* and 1*h* both add up to a whole digit or integer only value for each card hand, and all such card hands tie with each other. In the case of FIG. 1*g*, a 5 Hearts and 8 of Spades add up to 13, plus a Queen of Clubs and a Joker which add ½ point each to the hand, for a total of 14 points which count as 4 points for the card hand value. In FIG. 1*h*, a 6 of Clubs, 4 of Hearts, 3 of Diamonds and 4 of Clubs add up to 17 points, which count as 7 points for the card hand value.

From the foregoing it will be appreciated that the card game disclosed herein, called the LUCKY ½ card game, is easy to learn, simple to play on existing and commonly available casino equipment, and features a degree of interest and excitement comparable to that offered by the conventional game of blackjack.

While particular embodiments of the invention have been described and illustrated for purposes of clarity and example, it will be understood that many changes, substitutions and modifications to the presently preferred embodiments described above will become readily apparent to those possessed of ordinary skill in the art without thereby departing from the scope and spirit of the present invention which is defined by the following claims.

What is claimed is:

1. A method for playing a card game among two or more players comprising the steps of:

providing fifty-six playing cards including a standard poker deck of fifty-two cards plus four joker cards;

providing a card dealer for dealing said playing cards;

dealing an initial card hand consisting of two cards to each of the players:

offering each player the option to draw at least one additional card from said dealer; and exposing the card hands of all players to determine the winning card hand according to the following rules:

the point value of each natural number card is its face value and all figure cards and jokers have a value of ½ point;

any hand adding up to an integer plus ½ point wins over any hand adding up to an integer only value;

as between hands adding up to an integer plus ½ point, the hand with the higher integer value wins;

all hands adding up to an integer value tie with each other.

2. The method of claim 1 wherein said rules further comprise the rule that a card hand made up of two cards adding up to ten and ½ points wins over any other hand made up of more than two cards and also adding up to ten and ½ points.

3. The method of claim 1 wherein said rules further comprise the rule that any card hand adding up to an integer greater than ten acquires the value of the second digit only.

4. The method of claim 1, further comprising the step of each player placing a wager on said initial card hand prior to said dealing step.

5. The method of claim 4, further comprising the step of collecting said wagers and paying the collected wagers to the player holding the winning hand, or in case of a tie, distributing the collected wagers among the players holding the tied hands in equal shares.

6. The method of claim 4, wherein one of said players is designated as the banker, and the card hand of every other player is compared to the card hand of said banker following said step of exposing to determine the winning hand as between the banker and each of the other players, and further comprising the step of paying to the banker said wager placed by each player whose card hand loses to the card hand held by the banker, and paying by the banker to each player whose card hand wins against the card hand of the banker an amount equal to the wager placed by that player.

7. The method of claim 6, wherein said banker must draw from said dealer an additional card for any card hand held by the banker adding up to or less that 4½ points.

8. The method of claim 1, further comprising the step wherein a player optionally splits a said initial card hand consisting of two cards of equal face value by placing said two cards face down as split card hands on a playing surface, and wherein said step of offering comprises the step of optionally drawing from said dealer one or two additional cards on each of said split card hands for a maximum of three cards in each of said separate card hands.

9. The method of claim 8, wherein said step of optionally drawing comprises the step of dealing a first card face up on said playing surface.

10. The method of claim 7, wherein said step of optionally drawing comprises the step of dealing a second of said two additional cards face down on said playing surface.

11. The method of claim 1, further comprising the step wherein a player optionally splits a said initial card hand consisting of two cards of equal face value by placing said two cards face down as split card hands on a playing surface, and wherein said step of offering comprises the step of optionally drawing from said dealer a single additional card on each of said split card hands for a total of two cards for each of said split card hands.

12. The method of claim 9, wherein said banker may not split into separate card hands an initial hand consisting of two cards of ½ point value.

13. The method of claim 12, wherein said banker may draw up to three additional cards for a total of a five card hand in the event said banker is dealt an initial hand consisting of two of ½ point value.

14. A method for playing a card game among two or more players comprising the steps of:

providing fifty-six playing cards including a standard poker deck of fifty-two cards plus four joker cards;

providing a card dealer for dealing said playing cards;

each player placing a wager;

dealing an initial card hand consisting of two cards to each of the players:

offering each player the option to draw at least one additional card from said dealer;

exposing the card hands of all players to determine the winning card hand according to the following rules:

the point value of each natural number card is its face value and all figure cards and jokers have a value of ½ point;

any hand adding up to an integer plus ½ point wins over any hand adding up to an integer only value;

as between hands adding up to an integer plus ½ point, the hand with the higher integer value wins;

all hands adding up to an integer value tie with each other; and collecting said wagers and paying the collected wagers to the player holding the winning hand, or in case of a tie, distributing the collected wagers among the players holding the tied hands in equal shares.

15. The method of claim 14 wherein said rules further comprise the rule that a card hand made up of two cards adding up to ten and ½ points wins over any other hand made up of more than two cards and also adding up to ten and ½ points.

16. The method of claim 14 wherein said rules further comprise the rule that any card hand adding up to an integer greater than ten acquires the value of the second digit only.

17. The method of claim 14, further comprising the step wherein a player optionally splits a said initial card hand consisting of two cards of equal face value by placing said two cards face down as split card hands on a playing surface, said split card hands being subsequently played by said player as separate card hands by optionally drawing from said dealer one or two additional cards on each of said split card hands for a maximum of three cards in each of said separate card hands.

18. The method of claim 17, wherein said step of optionally drawing comprises the step of dealing a first card face up on said playing surface.

19. The method of claim 18, wherein said step of optionally drawing comprises the step of dealing a second of said two additional cards face down on said playing surface.

20. The method of claim 14, further comprising the step wherein a player optionally splits a said initial card hand consisting of two cards of equal face value by placing said two cards face down as split card hands on a playing surface, said split card hands being subsequently played by said player as separate card hands by optionally drawing from said dealer one or two additional cards on each of said split card hands for a maximum of three cards in each of said separate card hands face up on said playing surface as split card hands at the option of the player, and further comprising the step of optionally drawing from said dealer a single additional card on each of said split card hands for total of two cards for each said split card hands.

21. A method for playing a card game among two or more players comprising the steps of:

providing fifty-six playing cards including a standard poker deck of fifty-two cards plus four joker cards;

providing a card dealer for dealing said playing cards;

designating one of said players as the banker;

each player other than said banker placing a wager;

dealing an initial card hand consisting of two cards to each of the players:

offering each player the option to draw at least one additional card from said dealer;

exposing all card hands to determine the winning card hand as between said banker and all other players according to the following rules:

the point value of each natural number card is its face value and all figure cards and jokers have a value of ½ point;

any hand adding up to an integer plus ½ point wins over any hand adding up to an integer only value;

as between hands adding up to an integer plus ½ point, the hand with the higher integer value wins;

all hands adding up to an integer value tie with each other; and paying to the banker said wager placed by each player whose card hand loses to the card hand held by the banker, and paying by the banker to each player whose card hand wins against the card hand of the banker an amount equal to the wager placed by that player.

22. The method of claim 21, wherein said banker is also said dealer.

23. The method of claim 21 wherein said rules further comprise the rule that any card hand adding up to an integer greater than ten acquires the value of the second digit only.

24. The method of claim 21 wherein said rules further comprise the rule that a card hand made up of two cards adding up to ten and ½ points wins over any other hand made up of more than two cards and also adding up to ten and ½ points.

25. The method of claim 21, wherein said banker must draw from said dealer an additional card for any card hand held by the banker adding up to or less than 4½ points.

26. The method of claim 21, wherein said banker may not split into separate card hands an initial hand consisting of two cards of ½ point value.

27. The method of claim 26, wherein said banker may draw up to three additional cards for a total of a five card hand in the event said banker is dealt an initial hand consisting of two cards of ½ point value.

* * * * *